United States Patent [19]

Bogert et al.

[11] 4,127,335

[45] Nov. 28, 1978

[54] IMPACT PRINTER WITH CARTRIDGE PRINT WHEEL

[75] Inventors: David L. Bogert, Lewisville; Jimmie D. New, Arlington, both of Tex.

[73] Assignee: Xerox Corporation, Stamford, Conn.

[21] Appl. No.: 767,250

[22] Filed: Feb. 10, 1977

[51] Int. Cl.[2] ..... B41J 1/30

[52] U.S. Cl. ..... 400/144.2; 400/175

[58] Field of Search ..... 101/93.15, 93.16, 93.17, 101/111; 197/18, 49, 52-54; 206/444

[56] References Cited

U.S. PATENT DOCUMENTS

| | | | |
|---|---|---|---|
| 3,677,386 | 7/1972 | Herterich et al. | 197/53 |
| 3,772,988 | 11/1973 | Bowers, Jr. et al. | 101/111 |
| 3,774,531 | 11/1973 | Hansen et al. | 101/111 X |
| 3,858,509 | 1/1975 | Grundherr | 197/54 X |
| 3,892,303 | 7/1975 | Willcox | 197/53 X |
| 3,915,086 | 10/1975 | McManaman | 197/53 X |
| 3,991,873 | 11/1976 | Paulson et al. | 197/53 |
| 4,026,403 | 5/1977 | Inose et al. | 197/18 X |

*Primary Examiner*—Paul T. Sewell

*Attorney, Agent, or Firm*—Sheldon F. Raizes

[57] ABSTRACT

An impact printer is provided with an easy load print wheel mechanism. A print wheel cartridge containing a print wheel therein, is inserted into position without disturbing the position of a print wheel drive motor, a ribbon cartridge or hammer mechanism. The easy load mechanism automatically grabs the print wheel cartridge to swing the cartridge into a print wheel loaded position whereby the print wheel within the cartridge is automatically coupled to the print wheel drive motor shaft.

16 Claims, 13 Drawing Figures

IMPACT PRINTER WITH CARTRIDGE PRINT WHEEL

On current impact printers utilizing a rotatable print wheel, such as the "Xerox 800," a motor, hammer mechanism and ribbon cartridge are supported on a frame which is pivotably mounted on a carriage. The frame must be pivoted from a print position in order to replace the print wheel. Due to interfering structure, the ribbon cartridge must be removed to allow pivoting of the frame. It is desirable to provide a print wheel with a protective cartridge to protect the same during handling and storage and replace the print wheel with as simple a procedure as possible. It is also desirable to eliminate direct handling of a used print wheel when replacing the same to prevent an operator from accidentally getting ink on his hands or clothing.

It has been proposed in copending U.S. application Ser. No. 767,249, filed Feb. 10, 1977, common assignee, to provide a print wheel cartridge which contains a print wheel therein. An impact printer is provided with a mechanism which receives the cartridge to automatically couple the print wheel to a print wheel drive motor shaft without disturbing the operative position of the motor or ribbon cartridge.

It is an overall object of this invention to provide an improvement to the disclosed mechanism in the above-identified application.

It is a further object of this invention to provide a printer with an easy load print wheel cartridge apparatus wherein the cartridge is manipulated, after insertion into a guide, to bring a print wheel therein into coupling engagement with a print wheel drive motor shaft.

Other objects of the invention will become apparent from the following description with reference to the drawings wherein.

Figure 1:
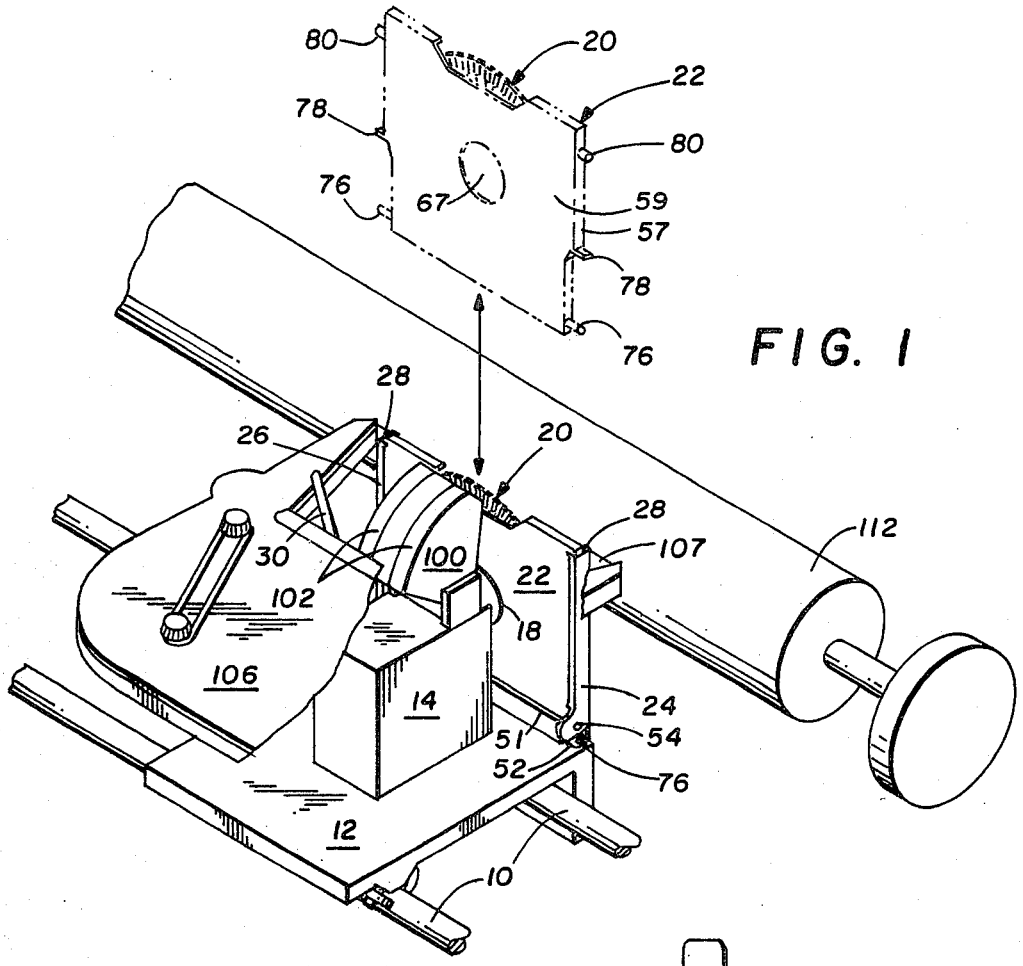
FIG. 1 is a simplified perspective view of a carriage and platen for an impact printer.
Figure 2:
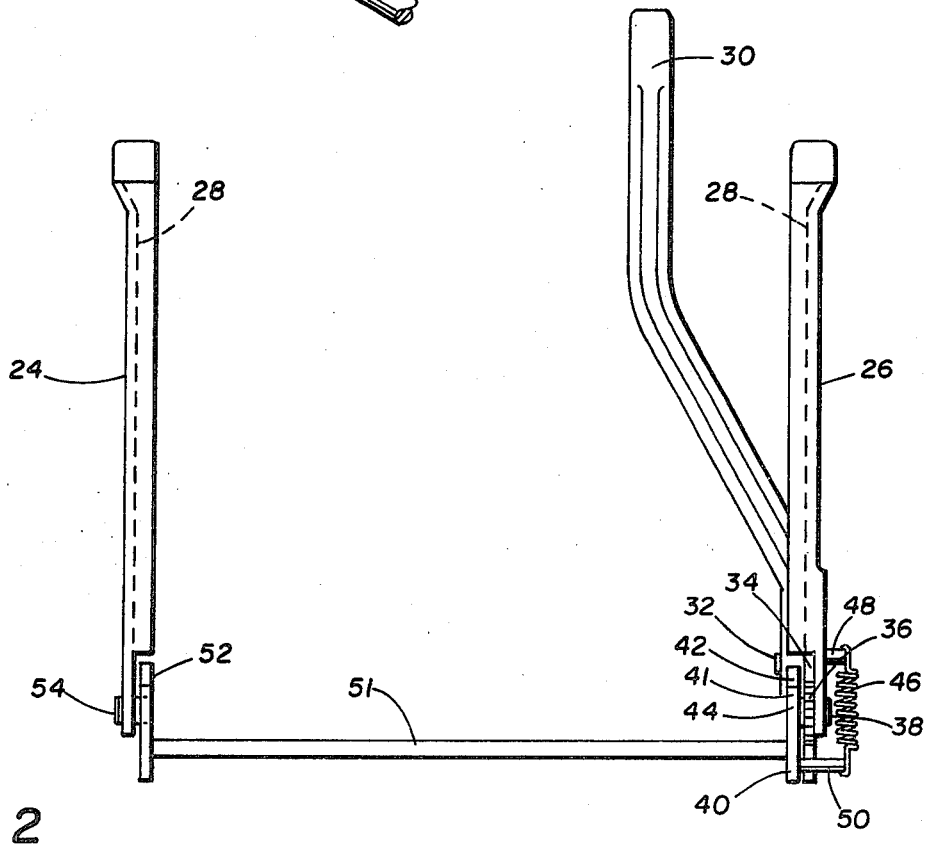
FIG. 2 is a front view of a pair of guides and a print wheel cartridge loading mechanism associated therewith.
Figure 3:
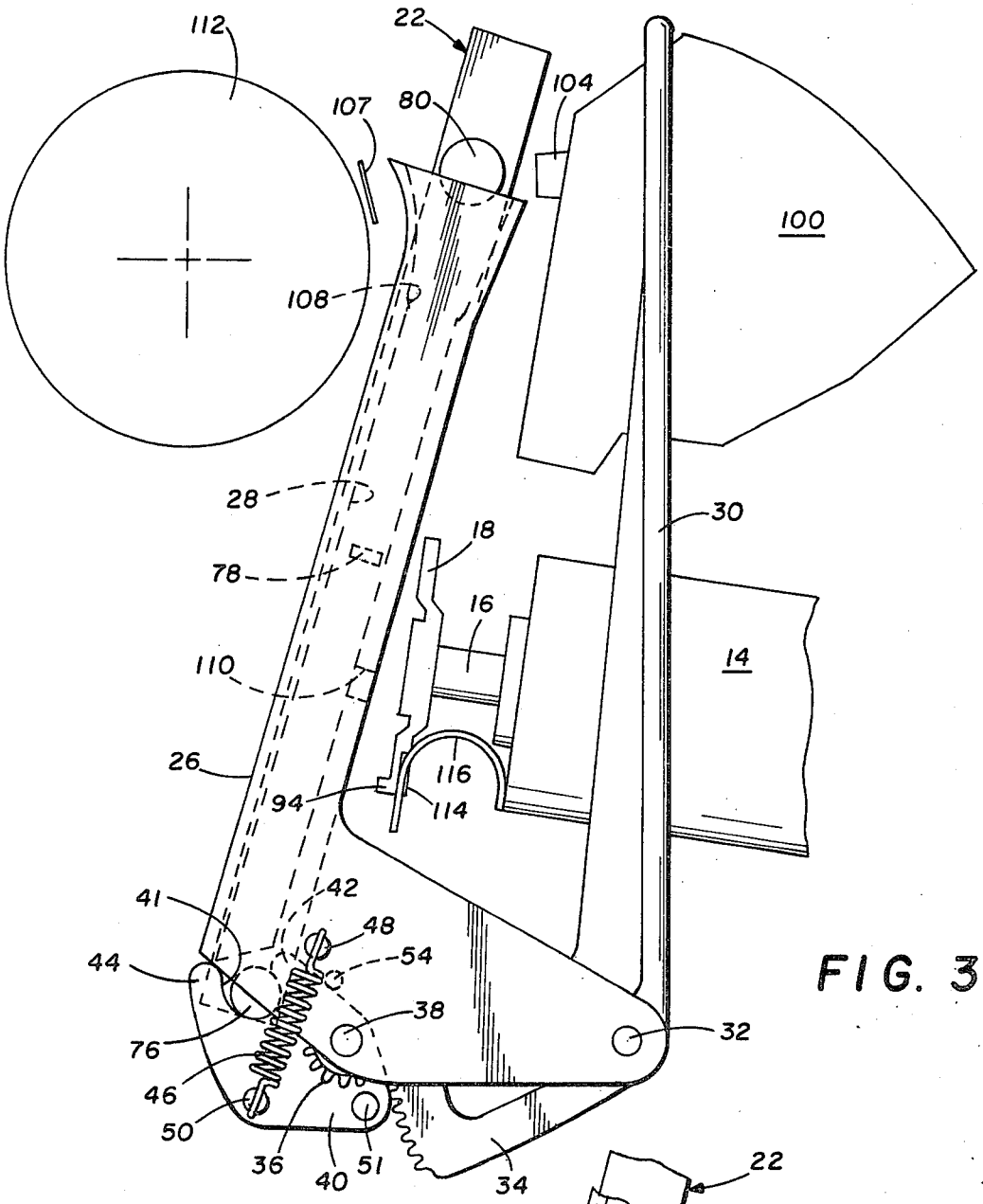
FIG. 3 is a side view, of a print wheel cartridge and loading mechanism therefor illustrating the same in print wheel unloaded position.
Figure 4:
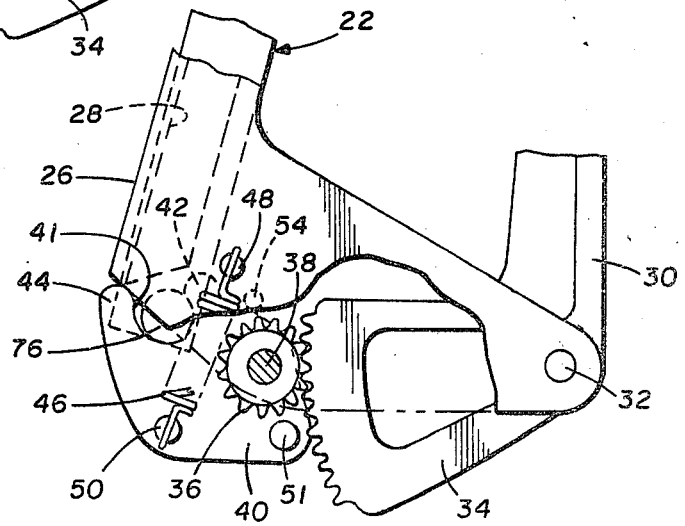
FIG. 4 is a partial view of FIG. 3 partially broken away.

Referring to FIG. 1, there is shown a simplified view of a printer sub-assembly. A pair of guide rails 10 slidably support a carriage 12 thereon. A print wheel drive motor 14 is connected to the carriage and has a rotatable drive shaft 16 (FIG. 3) extending therefrom. At the end of the shaft 16 is an enlarged head 18 which is adapted to couple the drive shaft 16 to a rotatable print wheel 20 carried in a cartridge 22. Also attached to the carriage 12 is a pair of laterally spaced apart guide rail plates 24, 26, each of which has a guide slot 28 therein. Referring now to FIGS. 2–4, a release lever 30 is rotatably mounted to the lower end of the guide rail plate 26 by pivot pin 32. The lever has a toothed sector 34 which engages a gear 36. A pivot pin 38 is rotatably mounted to the guide plate 26, and the gear 36 is secured to the rotatable pin 38 for rotation therewith. Also secured to the rotatable pin 38 for rotation therewith is a guide lever 40 with a recess 41 being defined between arms 42 and 44. An over-center spring 46 is attached at one end to a short bar 48 fixed to the guide plate 26 and at the other end to a bar 50 fixed to the lever 40. When the position or force of the spring is to the right of rotatable pin 38 (FIG. 5), the spring exerts a counter-clockwise force on the guide lever 40. When the position or force of the spring is to the left of pivot pin 38 (FIG. 3), the spring exerts a clockwise force on the guide lever 40. A force transmitting rod 51 interconnects the guide lever 40 with a guide lever 52 which is pivotably mounted by pin 54 on the lower portion of the guide plate 24. The lever 52 is the same shape as lever 40. Clockwise rotation of the guide levers 40 and 52 is limited by stop pin 54 on the lower end of each guide plate.

Figure 7:
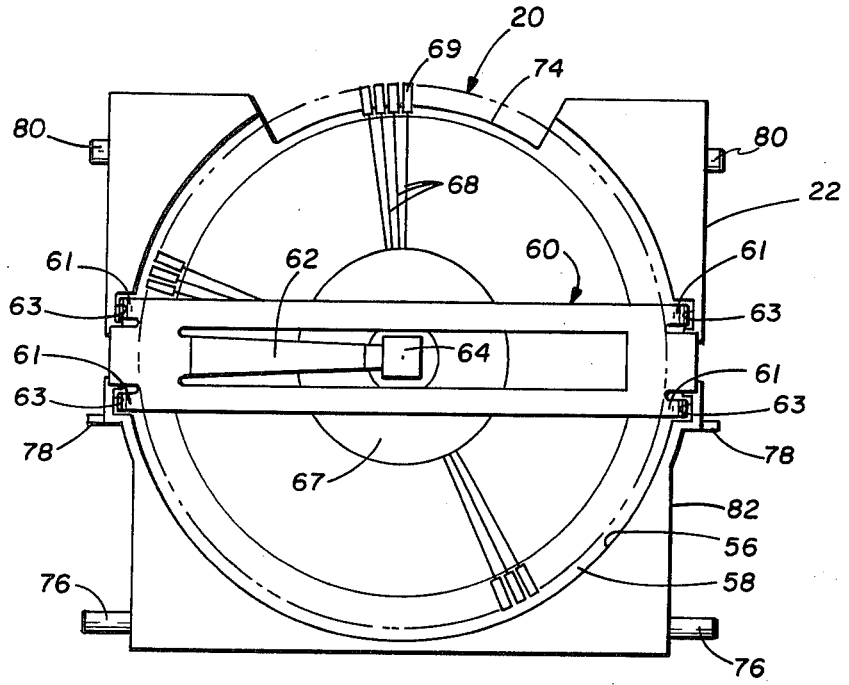
FIG. 7 is a view of a print wheel cartridge containing a print wheel.
Figure 8:
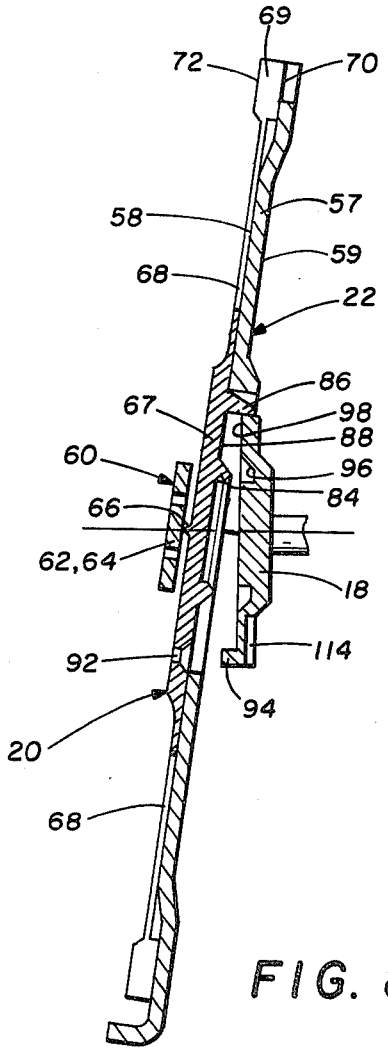
FIG. 8 is an elevation sectional view of a motor drive shaft head and print wheel cartridge in one relative position during print wheel loading.
Figure 9:
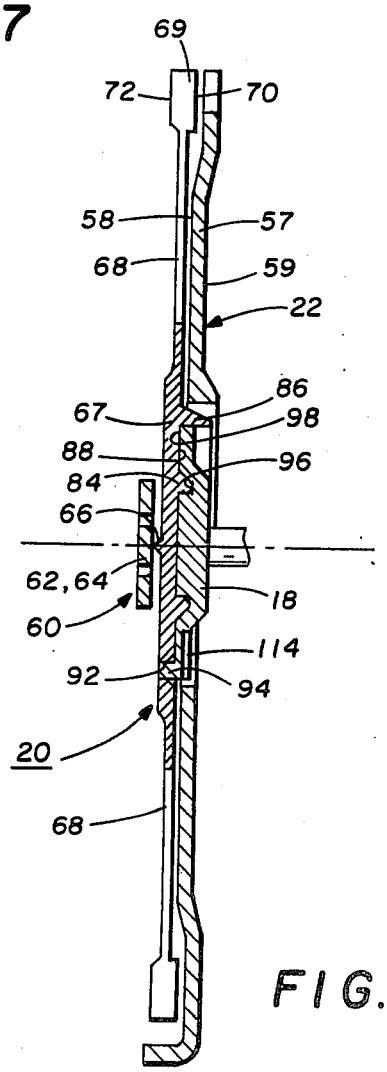
FIG. 9 is an elevation sectional view of the motor drive shaft head and print wheel cartridge in print wheel loaded position.
Figure 10:
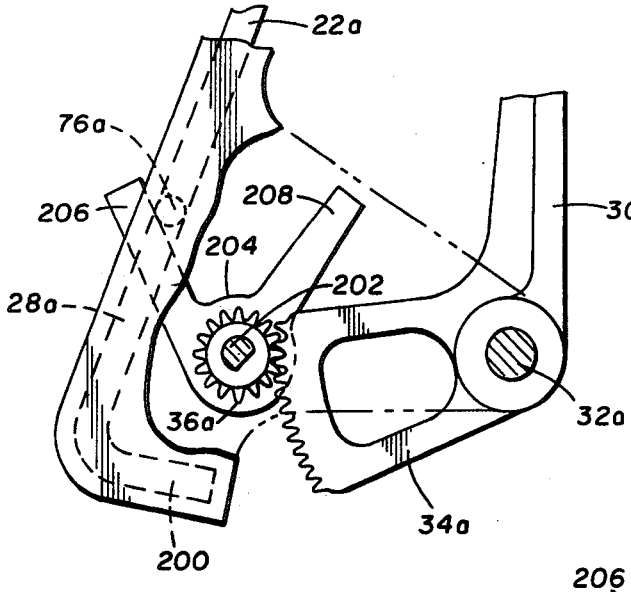
FIG. 10 is a partial side view, partially broken away, of a modification of the loading mechanism of FIGS. 3–6, illustrated in unloaded print wheel position.
Figure 11:
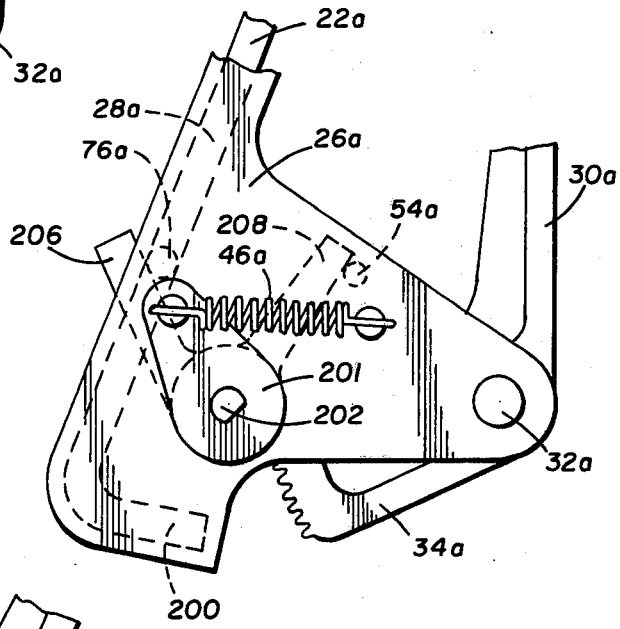
FIG. 11 is the same view as FIG. 10, only illustrating in full that portion of FIG. 10 which is broken away.
Figure 12:
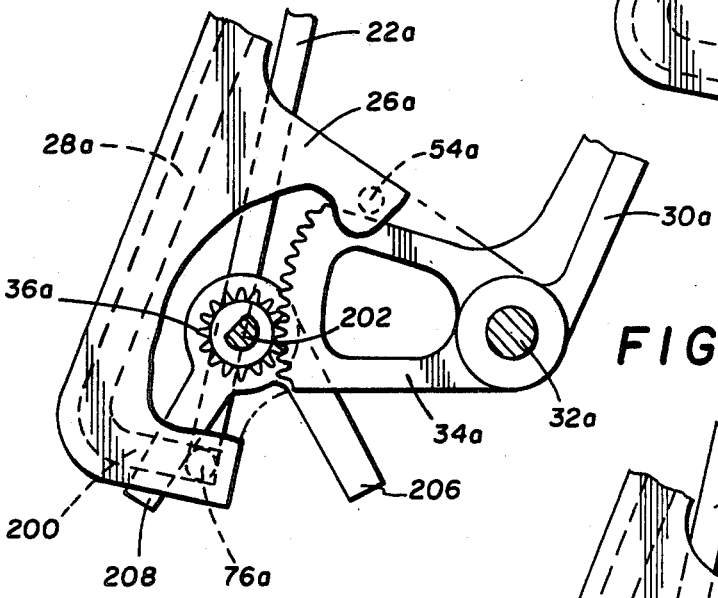
FIG. 12 is the same view as FIG. 11, only illustrated in a print wheel loaded position.
Figure 13:
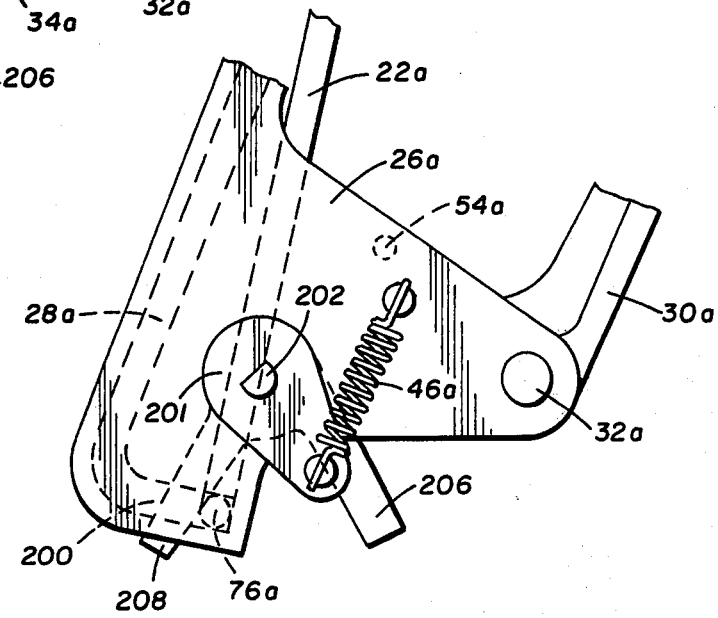
FIG. 13 is the same view as FIG. 12, only illustrating in full that portion of FIG. 12 which is broken away.

Referring to FIGS. 7–9, the print wheel cartridge 22 comprises a member having a generally circular recess 56 receiving the print wheel 20 therein. The recess has a back wall 57 having a front face 58 and a rear face 59. A thin metal leaf spring support clip 60 spans the recess 56 across the diameter thereof and has a pair of legs 61 at each end thereof which frictionally fit into complementary recesses 63 to hold the spring clip 60 in place on the cartridge 22. A finger 62 extends from one end of the clip 60 and is biased toward the rear wall 57 of the recess 56. The free end 64 of the spring finger 62 engages a projection 66 on the center of the print wheel 20 to bias the print wheel against the front face 58 of the recess wall 57. The print wheel 20 has a central hub portion 67 from which a plurality of spokes 68 radially extend. At the outer end of each spoke is secured a character pad 69 having a hammer impact face 70 and a print face 72 on which a character is formed. The cartridge 22 has an arcuate cut out portion 74 at the upper end thereof which exposes the hammer input face 70 of the character pads 69 to the rear of the cartridge. Three pair of guide pins 76, 78 and 80 are formed on the cartridge and project from lower, middle and top of the side walls 82 of the cartridge 22 respectively, for purposes to be explained hereafter. The rear face of the print wheel hub 67 has an annular rib 84 and a semi-annular rib 86 forming a semi-annular locating recess 88 therebetween. An opening 92 is formed in the hub 67 to receive a locating key 94 formed on the shaft head 18. When the shaft head 18 is engaged with the print wheel hub 67, the rib 84 is received in a mating annular recess 96 on the shaft head and an annular peripheral flat portion 98 of the shaft head is received in the mating locating recess 88.

Referring back to FIG. 1, a moving coil print hammer mechanism 100 is rigidly secured to the carriage 12 and sits above the motor 14. The hammer mechanism comprises a pair of opposing permanent magnets 102 with a swinging hammer 104 (FIGS. 3 and 5) therebetween. The hammer 104 has a coil of magnetic wire (not shown) wrapped thereon. When current is passed through the coil, the magnetic field generated results in the hammer being thrust forward. For a more detailed explanation of the operation and mechanism of such a hammer, reference is made to U.S. Pat. Nos. 3,279,362 and 3,279,364, which are hereby incorporated herein by reference. A ribbon cartridge 106, (only partially shown for clarity of the other elements) having a ribbon 107 therein, is supported on a platform (not shown) secured to the carriage 12. The ribbon cartridge can be of any conventional construction.

The print wheel cartridge 22 is loaded into a print wheel loaded position without disturbing any of the positions of the ribbon cartridge 106, hammer mechanism 100, or motor 14. This is accomplished in the following manner with reference to FIGS. 3–6: The lower guide pins 76 are inserted into the guide slots 28 of the guide rails and thereafter the middle guide pins 78 and upper guide pins 80 are also inserted into the guide slots 28. The guide pins 76 and 80 are cylindrical in shape, while the middle guide pins 78 are rectangular or flat in shape. The middle guide pins 78 serve to stabilize the cartridge in the guide rail to facilitate movement thereof until the upper guide pins 80 enter the slots 28. The upper pins 80 are of slightly larger diameter than the lower pins 76, and the upper end of the slots each has a necked-in portion 108 which serves as a stop for pins 80.

Figure 5:
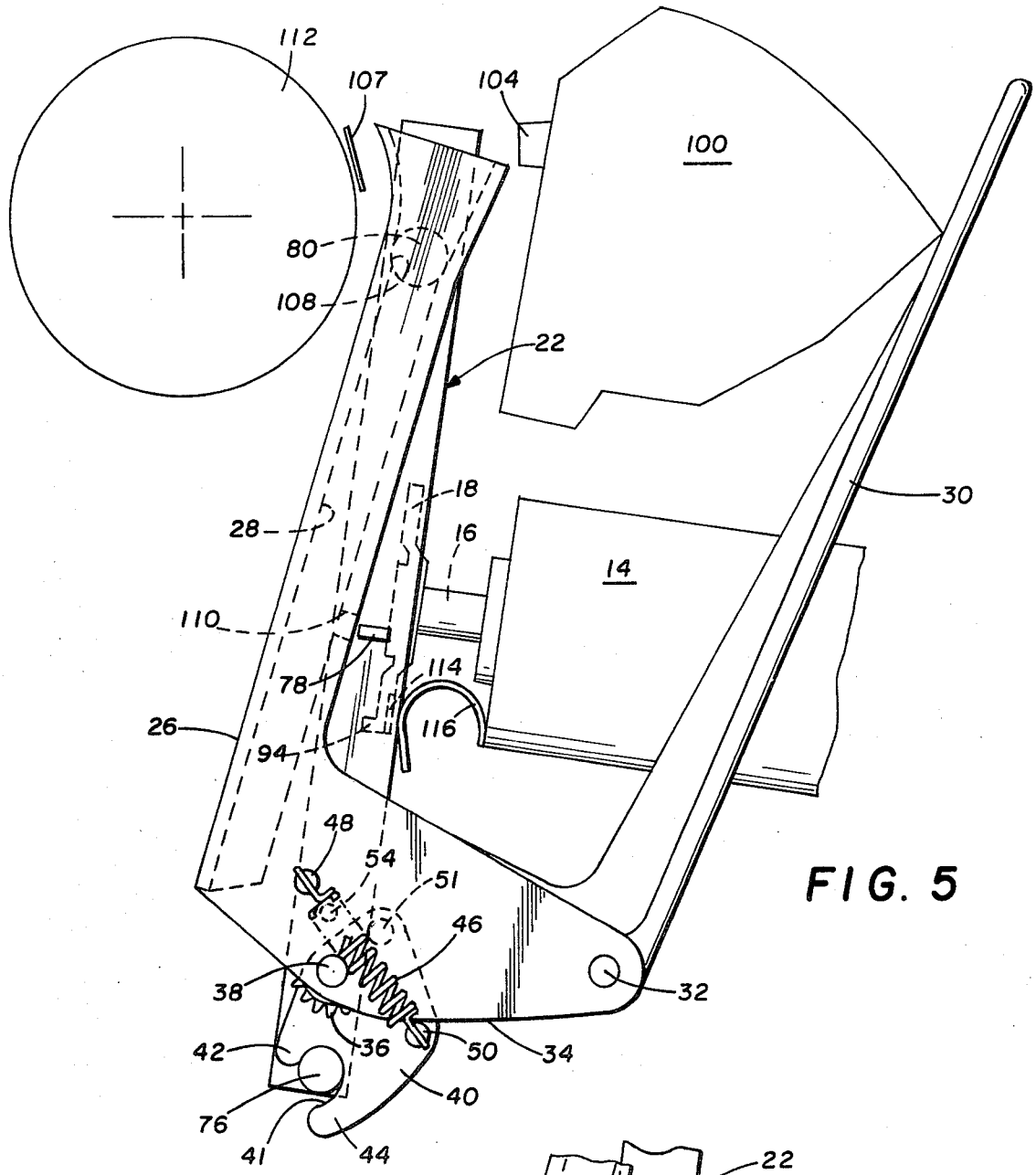
FIG. 5 is the same view as FIG. 3, only illustrating the cartridge and loading mechanism therefor in a print wheel loaded position.
Figure 6:
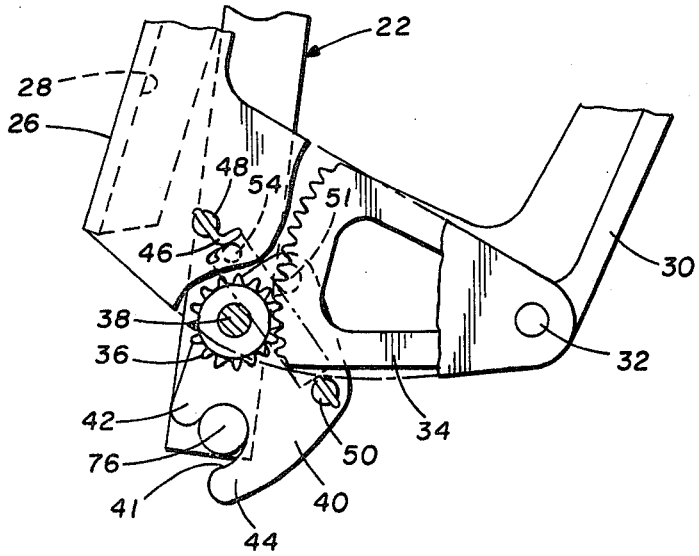
FIG. 6 is a partial view of FIG. 5, partially broken away.

As the cartridge is lowered into position, the lower guide pins 76 will engage a respective finger 44 of the guide levers 40 and 52 and be cammed into the recess 41. Further downward pressure exerted on the cartridge will result in the guide levers 40 and 52 rotating counter-clockwise with its respective rotatable pin 38 thereby stretching over-center spring 46 until the force thereof shifts to the right (FIG. 5) of the rotatable pin 38 whereby the spring exerts a counter-clockwise rotational force on the guide levers 40 and 52 to snap the guide levers to a print wheel loaded position as shown in FIG. 5. Any force exerted on guide lever 40 by spring 46 is transmitted to guide lever 52 through connecting rod 51. As the cartridge moves downward after the lower guide pins 76 have engaged levers 40 and 52, the upper guide pins 80 engage the necked portion 108 and stop at that location to prevent further downward movement of the cartridge. The cartridge pivots about the upper pins 80 as the levers 40, 52 swing the lower end of the cartridge to the print wheel loaded position. Referring to FIG. 8, the relative position of the cartridge 22, print wheel 20, and the shaft head 18 is shown in approximately the half loaded position as the cartridge is being pivoted about the upper pins 80 towards the shaft head 18. Referring to FIG. 9, the cartridge 22, print wheel 20 and shaft head 18 are illustrated in print wheel fully loaded position. As the shaft head 18 engages the print wheel hub, the print wheel is forced away from the front face 58 of the wall 57 of the cartridge against the force of the spring finger 62 whereby the print wheel is free to be rotatably driven by the shaft 16. The print wheel 20 rotates relatively to the spring finger end 64 without significant friction therebetween due to the point contact between the spring finger end 64 and the pointed tip 66. A cross slot 110 (FIGS. 3 and 5) is located on each guide plate 24, 26 and intersects a respective one of the guide slots 28. The cross slot 110 is located to allow the middle guide pin 78 to pass therethrough when the cartridge is swung to print wheel loaded position by the guide levers 40, 52.

As the lever 40 rotates, the shaft 38 and the gear 36 rotate therewith, thereby causing the release lever 30 to rotate in a clockwise direction about its pivot pin 32 to a print wheel loaded position as shown in FIG. 5. When it is desired to remove the print wheel, the release lever 30 is rotated in a counter-clockwise direction thereby rotating the rear 36, the pin 38 and the lever 40 in a clockwise direction against the force of the over-center spring 46 until the spring force switches to the left side (FIG. 3) of the pivot pin 38 at which time the spring exerts a clockwise rotational force on the guide lever 40 to return the same to the print wheel unloaded position illustrated in FIG. 3, where the cartridge can be removed from the guide slots 28. The motion transmitted to the lever 40 by lever 30 is also transmitted to the lever 52 by the connecting rod 51.

When the print wheel is in loaded position, the print wheel 20 is rotated by the motor 14 with the character pads 69, exposed by opening 74 in the cartridge wall, rotating past the hammer 104. The hammer is positioned to strike the hammer impact face 70 of a selected character pad to force the character face 72 against the ribbon 107 and a sheet of paper (not shown) on a platen 112 to print a selected character on the sheet.

A notch 114 is located in the rear face of the shaft head 18 for receiving a portion of the free end of a leaf spring 116 which is fixed at one end to the housing of motor 14. The electronics of the system for operating the printer is designed to stop the print wheel at the same given position at the end of any given command or series of commands. The notch 114 on the shaft head 18, at this position, is aligned with the leaf spring 116. In the print wheel loaded position, as shown in FIG. 5, the rear face 59 of the wall 57 of the cartridge engages the leaf spring 116 to hold the same away from the notch 114. When the cartridge is removed, the spring expands to locate in the notch 114, as illustrated in FIG. 3, to hold the head in place so a new print wheel will be properly oriented with respect to the electronic position of the shaft. As the print wheel is loaded, the wall 59 of the cartridge engages the leaf spring 116 removing the same from the notch 114 freeing the shaft for rotation.

Referring to FIGS. 10–13, a modification of the embodiment of FIGS. 1–6 is illustrated. Those elements which are the same as in the previous embodiment are designated by the same reference numerals, only with an "*a*" affixed thereto. The guide slots 28*a* have been extended to provide a transverse horizontal portion 200 at the lower end thereof. A crank arm 201 is secured to a shaft 202 for rotation therewith. The shaft 202 extends from the guide plate 26*a* across to the guide plate 24*a* (not shown), where it is rotatably mounted thereto. A guide lever 204 and a similar lever (not shown) associated with guide plate 24*a* and gear 36*a* are fixed to the shaft 202 for rotation therewith. The over-center spring 46*a* is secured at one end to the crank arm 201 and serves to bias the crank arm 201 and thereby the guide lever 204 in opposite rotational directions depending on which side of the pivot shaft 202 the force of spring 46*a* is. The guide lever 204 comprises a pair of arms 206, 208 which extend radially outwards from a center portion thereof. When the print wheel is being loaded (See FIGS. 10 and 11), the lower guide pin 76*a* on the cartridge 22*a* engages the arm 206 and moves guide lever 204 counter-clockwise against the force of spring 46*a* until the spring shifts to the right of pivot shaft 202 at which point the force of spring 46*a* takes over. This point is just prior to the guide pin 76*a* reaching the horizontal extension 200. The spring 46*a* effects continued counter-clockwise rotation of the lever 204 to bring arm 208 into contact with the guide pin 76*a* to force the same along the horizontal extension 200 thereby causing the print wheel cartridge 22*a* to swing about upper guide pins, not shown, but the same as guide pins 80, into print wheel loaded position (See FIGS. 12 and 13). When it is desired to change the print wheel, the release lever 30*a* is rotated in a counter-clockwise direction to rotate guide lever 204 in a clockwise direction to bring arm 206 into engagement with guide pin 76*a* to first swing the print wheel cartridge horizontally away from the shaft head and then move the same vertically upwards where it can be removed.

What is claimed is:

1. In an impact printer: a movable carriage, a motor supported by said carriage, a rotatable shaft extending from said motor and having drive coupling means at one end thereof, a cartridge, a print wheel supported by said cartridge and rotatable about a given axis relative to said cartridge, said print wheel having cooperating means engageable with said coupling means in such a manner that said print wheel is driven by said shaft, said carriage having guide means supported thereon for slidably receiving said cartridge therein, said guide means being arranged for guiding said cartridge for movement in a direction generally transverse to the axis of rotation of said shaft to a position where said drive coupling means is generally adjacent to said cooperating means, said cartridge and said guide means being so constructed that said cartridge is pivotable on said guide means about an axis which is generally transverse to said shaft, means for engaging said cartridge and pivoting said cartridge about said pivot axis and thereby effect movement of said cooperating means in a direction to connect said coupling means with said cooperating means in a print wheel loaded position.

2. The structure as recited in claim 1 further comprising: said print wheel having a plurality of spokes extending radially outwards from a center portion, each of said spokes having a character pad at the outer end thereof, each character pad having a hammer impact face and a print face, said cartridge having a wall extending generally parallel to said spokes, an opening in said wall exposing said cooperating means, biasing means operatively connected to said print wheel and said cartridge to bias said print wheel in an axial direction toward said wall, said cartridge being arranged to expose at a print station at least the hammer impact area and the print face of at least one character pad, said coupling means extending through said opening into engagement with said cooperating means in said print wheel loaded position, said coupling means moving said print wheel in an axial direction away from said wall against the force of said biasing means when brought into engagement with said cooperating means.

3. The structure as recited in claim 1 wherein said cartridge has at least one projection thereon; said means for moving said cartridge comprising a guide lever member rotatable about a given axis; said guide lever member being rotatable between a projection receiving position and a print wheel loaded position; said guide lever member comprising a pair of spaced arms defining a projection gripping recess therebetween; one of said arms, in said receiving position, being in the path of travel of said projection to be engaged thereby when said cartridge is moved along said guide means; over-center spring means operatively connected to said guide lever member for urging the same in opposite rotational directions depending upon the location of said spring force relative to the axis of rotation of said guide lever member and alternately holding the same in said receiving position and print wheel loaded position; said arms and spring means being so arranged relative to each other that engagement of said first arm by said one projection causes said guide lever member to rotate toward said print wheel loaded position against the force of said spring means thereby bringing said other arm into said path to follow said one projection to grip said one projection in said recess, continued rotation of said guide lever member effecting shifting of the force of said spring means relative to the axis of rotation of said guide lever member to impose a rotational force on said guide lever member toward said print wheel loaded position to thereby pivot said cartridge about its pivotal axis.

4. The structure as recited in claim 1 wherein said guide means comprises a pair of laterally spaced members, each having a guide slot therein; said cartridge having a pair of laterally spaced projections thereon located in a respective one of said slots during movement of said cartridge along said guide means; said means for moving said cartridge comprising a pair of laterally spaced guide lever members; each guide lever member being rotatable between a projection receiving position and a print wheel loaded position; each guide lever member including a pair of spaced arms defining a projection gripping recess therebetween; one of said arms of each guide lever member, in said receiving position, being in the path of travel of a respective one of said projections when said projections are moved along said slots; over-center spring means operatively connected to said guide lever members for urging the same in opposite rotational directions depending upon the location of the spring force relative to the axis of rotation of said guide lever members and for alternately holding the same in said receiving position and said print wheel loaded position; each guide lever member and said spring means being so arranged relative to each other that engagement of said one arm of each guide lever member by a respective said projection causes each said guide lever member to rotate toward said print wheel loaded position against the force of said spring means thereby gripping a respective projection in its recess, continued rotation of said guide lever member effecting shifting of the force of said spring means relative to the axis of rotation of said guide lever members to effect a rotational force on said guide lever members by said spring means toward said print wheel loaded position to thereby pivot said cartridge about its pivotal axis.

5. The structure as recited in claim 4 wherein said cartridge has a second pair of laterally spaced projections spatially removed from said first named pair of projections in the direction of guided travel of said cartridge, each of said second pair of projections being located in a respective one of said slots during movement of said cartridge along said guide means, said projections forming said pivotal axis about which said cartridge pivots on said guide means.

6. The structure as recited in claim 5 wherein said cartridge has a third pair of laterally spaced projections located between said first named pair of guide projections and said second pair of projections, said third pair of projections being located in said guide slots during movement of said cartridge to said first named position for stabilizing movement of said cartridge on said guide slots; said guide slots each having an opening therein; said third pair of projections and said slot openings being arranged that said third pair of projections will pass through a respective said slot opening upon pivotal movement of said cartridge into said print wheel loaded position.

7. The structure as recited in claim 5 wherein said cartridge has at least one projection located between one of said first named pair of guide projections and one of said second pair of projections, said at least one projection being located in one of said guide slots during movement of said cartridge to said first named position for stabilizing movement of said cartridge on said guide slots; said one guide slot having an opening therein; said at least one projection and said slot opening being arranged that said at least one projection will pass through said slot opening upon pivotal movement of said holder into said print wheel loaded position.

8. The structure as recited in claim 1 wherein said cartridge has at least one projection thereon; said guide means including a portion extending in a generally axial direction; said means for moving said cartridge comprising a guide lever member rotatable about a given axis; said guide lever member being rotatable between a projection receiving position and a print wheel loaded position; said guide lever member comprising a pair of spaced arms; one of said arms, in said receiving position, being in the path of travel of said projection to be engaged thereby when said cartridge is moved along said guide means; over-center spring means operatively connected to said guide lever member for urging the same in opposite rotational directions depending upon the location of said spring force relative to the axis of rotation of said guide lever member and alternately holding the same in said receiving position and print wheel loaded position; said arms and spring means being so arranged relative to each other that engagement of said first arm by said one projection causes said guide lever member to rotate toward said print wheel loaded position against the force of said spring means and effecting shifting of the force of said spring means relative to the axis of rotation of said guide lever member, continued rotation of said guide lever member effecting a rotational force on said guide lever member toward said print wheel loaded position thereby bringing the other arm into driving contact with said one projection to drive the same along said generally axially extending portion of said guide means to thereby pivot said cartridge about its pivotal axis.

9. The structure as recited in claim 1 wherein said guide means comprises a pair of laterally spaced members, each having a guide slot therein including a portion extending in a generally axial direction; said cartridge having a pair of laterally spaced projections thereon located in a respective one of said slots during movement of said cartridge along said guide means; said means for moving said cartridge comprising a pair of laterally spaced guide lever members; each guide lever member being rotatable between a projection receiving position and a print wheel loaded position; each guide lever member including a pair of spaced arms, one of said arms of each guide lever member, in said receiving position, being in the path of travel of a respective one of said projections when said projections are moved along said slots; over-center spring means operatively connected to said guide lever members for urging the same in opposite rotational directions depending upon the location of the spring force relative to the axis of rotation of said guide lever members and for alternately holding the same in said receiving position and said print wheel loaded position; each guide lever member and said spring means being so arranged relative to each other that engagement of said one arm of each guide lever member by a respective said projection causes each said guide lever member to rotate toward said print wheel loaded position against the force of said spring means thereby effecting shifting of the force of said spring means relative to the axis of rotation of said guide lever members, continued rotation of said guide lever members effecting a rotational force on said guide lever members by said spring means toward said print wheel loaded position thereby bringing the other of said arms of each guide lever member into driving contact with a respective projection to thereby drive the same along said generally axially extending portion of its respective said guide slot to pivot said cartridge about its pivotal axis.

10. The structure as recited in claim 9 wherein said cartridge has a second pair of laterally spaced projections spatially removed from said first named pair of projections in the direction of guided travel of said cartridge, each of said second pair of projections being located in a respective one of said slots during movement of said cartridge along said guide means, said projections forming said pivotal axis about which said cartridge pivots on said guide means.

11. The structure as recited in claim 10 wherein said cartridge has a third pair of laterally spaced projections located between said first named pair of guide projections and said second pair of projections, said third pair of projections being located in said guide slots during movement of said cartridge to said first named position for stabilizing movement of said cartridge on said guide slots; said guide slots each having an opening therein; said third pair of projections and said slot openings being arranged that said third pair of projections will pass through a respective said slot opening upon pivotal movement of said cartridge into said print wheel loaded position.

12. The structure as recited in claim 10 wherein said cartridge has at least one projection located between one of said first named pair of guide projections and one of said second pair of projections, said at least one projection being located in one of said guide slots during movement of said cartridge to said first named position for stabilizing movement of said cartridge on said guide slots; said one guide slot having an opening therein; said at least one projection and said slot opening being arranged that said at least one projection will pass through said slot opening upon pivotal movement of said holder into said print wheel loaded position.

13. In an impact printer: a movable carriage, a motor supported by said carriage, a rotatable shaft extending from said motor and having drive coupling means at one end thereof, a cartridge, a print wheel supported by said cartridge and rotatable about a given axis relative to said cartridge, said print wheel having cooperating means engageable with said coupling means in such a manner that said print wheel is driven by said shaft, said carriage having guide means being arranged for guiding said cartridge for movement in a direction generally transverse to the axis of rotation of said shaft to a position where said drive coupling means is generally adjacent to said cooperating means, means for moving said cartridge and thereby effect movement of said cooperating means in a direction to connect said coupling means with said cooperating means in a print wheel loaded position, latching means operably engaging said drive coupling means for locking said shaft against rotation, said latching means being so located to be engageable by said cartridge to disengage said latching means from said drive coupling means to unlock said shaft during movement of said cartridge in a direction to connect said cooperating means with said coupling means.

14. In an impact printer for use with a print wheel cartridge: a movable carriage, a motor supported by said carriage, a rotatable shaft extending from said motor and having drive coupling means at one end thereof, said carriage having guide means for receiving the cartridge therein, said guide means comprising a pair of laterally spaced members, each having a guide slot therein for guiding the cartridge for movement in a direction generally transverse to the axis of said shaft, and means for moving the cartridge in a direction towards said drive coupling means into a print wheel loaded position comprising a pair of laterally spaced guide lever members, each guide lever member being rotatable between a cartridge actuating position and a print wheel loaded position; each guide lever member including a pair of spaced arms, one of said arms of each guide lever member, in said cartridge actuating position, being in the path defined by said slots; the other arm of each said guide lever member being rotatable past said path following said one arm during rotation of said guide lever members from said cartridge actuating position to said print wheel loaded position; and overcenter spring means operatively connected to said guide lever members for urging the same in opposite rotational directions depending upon the location of the spring force relative to the axis of rotation of said guide lever members and for alternately holding the same in said cartridge actuating position and said print wheel loaded position.

15. In an impact printer for use with a print wheel cartridge: a movable carriage, a motor supported by said carriage, a rotatable shaft extending from said motor and having drive coupling means at one end thereof, said carriage having guide means for receiving the cartridge therein, said guide means being arranged for guiding the cartridge for movement in a direction generally transverse to the axis of said shaft, means for moving the cartridge in a direction towards said drive coupling means into a print wheel loaded position, latching means operably engaging said drive coupling means for locking said shaft against rotation, said latching means being so located to be engageable by the cartridge to disengage said latching means from said drive coupling means to unlock said shaft during movement of the cartridge towards said drive coupling means.

16. In an impact printer for use with a print wheel cartridge: a moveable carriage, a motor supported by said carriage, a rotatable shaft extending from said motor and having drive coupling means at one end thereof, said carriage having guide means supported thereon for slidably receiving the cartridge therein, said guide means being arranged for guiding the cartridge for movement in a direction generally transverse to the axis of said shaft, said guide means having means for pivotably supporting the cartridge on an axis which is generally transverse to said shaft, and means carried by said carriage for engaging the cartridge and pivoting the cartridge about said pivot supporting means in a direction towards said drive coupling means into a print wheel loaded position.

* * * * *